US005427522A

United States Patent [19]

McDonough et al.

[11] Patent Number: 5,427,522

[45] Date of Patent: Jun. 27, 1995

[54] SELECTIVELY ACTUATABLE LIGHTER

[75] Inventors: James M. McDonough, Guilford, Conn.; Michel Doucet, Bains/S/Oust Redon, France

[73] Assignee: Bic Corporation, Milford, Conn.

[21] Appl. No.: 965,832

[22] Filed: Oct. 23, 1992

Related U.S. Application Data

[63] Continuation-in-part of Ser. No. 723,989, Jul. 1, 1991, and a continuation-in-part of Ser. No. 912,421, Jul. 10, 1992, abandoned, which is a continuation of Ser. No. 609,668, Nov. 6, 1990, abandoned, Ser. No. 723,989, Nov. 6, 1990, which is a continuation-in-part of Ser. No. 609,668, Nov. 6, 1990, abandoned, which is a continuation of Ser. No. 239,734, Sep. 2, 1988, Pat. No. 5,002,482.

[51] Int. Cl.[6] ..... F23D 11/36

[52] U.S. Cl. ..... 431/153; 431/255; 431/277; 222/153.13

[58] Field of Search ..... 431/153, 344, 255, 272; 222/153, 402.11

[56] References Cited

U.S. PATENT DOCUMENTS

| | | | |
|---|---|---|---|
| 1,895,032 | 1/1933 | Fisher | 431/255 X |
| 3,547,566 | 12/1970 | Tamarin . | |
| 4,028,043 | 6/1977 | Neuet | 431/144 |
| 4,049,370 | 9/1977 | Neust | 431/144 |
| 4,717,335 | 1/1988 | Loveless . | |
| 4,784,601 | 11/1988 | Nitta | 431/153 |
| 4,784,602 | 11/1988 | Nitta | 431/153 |
| 4,786,248 | 11/1988 | Nitta | 431/153 X |
| 4,830,603 | 5/1989 | Cirami | 431/153 |
| 4,832,596 | 5/1989 | Morris, Sr. | 431/153 |
| 4,904,180 | 2/1990 | Nitts | 431/153 |
| 4,921,420 | 5/1990 | Johnston | 431/153 |
| 5,074,781 | 12/1991 | Fujita | 431/153 |
| 5,076,783 | 12/1991 | Fremund | 431/153 |
| 5,090,893 | 2/1992 | Floriot | 431/153 |
| 5,145,358 | 9/1992 | Shike et al. | 431/153 |
| 5,165,885 | 11/1992 | Iwahori | 431/153 |
| 5,165,886 | 11/1992 | Frigiere | 431/153 X |
| 5,184,948 | 2/1993 | Iwahori | 431/276 X |
| 5,217,364 | 6/1993 | Frigiere | 431/344 |
| 5,224,854 | 7/1993 | Ansquer | 431/153 |
| 5,228,549 | 7/1993 | Frigiere | 431/153 X |

FOREIGN PATENT DOCUMENTS

| | | | |
|---|---|---|---|
| 8902796 | 8/1989 | Spain | 431/153 |

*Primary Examiner*—Carl D. Price

*Attorney, Agent, or Firm*—Pennie & Edmonds

[57] ABSTRACT

A selectively actuatable lighter device is disclosed which includes a body defining reservoir for containing a combustible gaseous medium such as butane, and having a valve arranged to be selectively actuated between a normally closed position and an open position which permits the exit of the gaseous medium. Such lighter can selectively produce sparks at a location proximate to the gaseous medium exit to ignite the gaseous medium. Such lighter device embodies a resiliently releasable latch means which normally prevents actuation of a valve actuator to the open position thereby preventing actuation of the valve. The latch means includes a latch which is selectively movable to a position out of interference with the valve actuator, so that the gaseous medium may be released and ignited by the sparks. The latch means is resiliently structured and mounted such that once the valve actuator is depressed and released, the latch returns to its closed or latched position to prevent actuation of the valve to the open position. To "re-use" the lighter, the latch must again be moved to an unlatched position so that the valve actuator can be opened for subsequent ignition of the gaseous medium.

24 Claims, 6 Drawing Sheets

SELECTIVELY ACTUATABLE LIGHTER

CROSS-REFERENCE TO RELATED APPLICATIONS

This is a continuation-in-part of U.S. patent application Ser. No. 07/723,989 filed on Jul. 1, 1991, entitled "Selectively Actuatable Lighter", which is a continuation-in-part of U.S. patent application Ser. No. 07/609,668 filed on Nov. 6, 1990, entitled "Selectively Actuatable Lighter", abandoned, which is a continuation of Ser. No. 07/239,734 filed on Sep. 2, 1988, entitled "Selectively Actuatable Lighter", which issued on Mar. 26, 1991 as U.S. Pat. No. 5,002,482. This is also a continuation-in-part of U.S. patent application Ser. No. 07/912,421, filed on Jul. 10, 1992, entitled "Selectively Actuatable Lighter", abandoned which is a continuation of U.S. patent application Ser. No. 07/609,668 filed on Nov. 6, 1990, abandoned. Each of these four patent applications is incorporated herein by reference.

This application is also related to U.S. Pat. No. 5,125,829, entitled "Bidirectional Selectively Actuatable Lighter" which issued on Jun. 30, 1992, and U.S. Pat. No. 5,092,764, entitled "Selectively Actuatable Lighter With Locking Value Cap" which issued on Mar. 3, 1992. This application is also related to U.S. patent application Ser. Nos. 07/965,958, 07/965,596 and 07/965,831, each entitled "Selectively Actuatable Lighter" and each filed concurrently herewith. Each of these two patents and three patent applications is incorporated herein by reference.

BACKGROUND OF THE INVENTION

1. Technical Field

This invention relates generally to lighters which consume fuel such as, for example, butane which is stored in a reservoir in a liquid state, then passed through a valve means and finally ignited by a spark or other similar means. More particularly, the invention relates to a butane cigarette lighter having a feature which interferes with depression of a valve actuator and in turn hinders expulsion of fuel from a valve nozzle (i.e., fuel nozzle) and/or generation of sparks thereby rendering operation of the lighter by young children even more difficult. Advantageously, this feature of the lighter may be deactivated by moving a latch to a non-interfering position, thus facilitating flame production.

2. Description of the Art

Numerous lighters are known, some of them incorporating features which are designed to render operation of the lighter more difficult by certain users. Some of such features relate to mechanisms which are designed to prevent ignition of a fuel source unless the lighter is properly oriented, mechanisms which are designed to automatically turn off a fuel source supply valve, and tamper protection arrangements.

More recently, attention has been directed toward preventing ready actuation of such lighters by persons normally not able to appreciate the potential danger of the flame. Individuals normally contemplated in these efforts are young children, in the age category younger than five years.

U.S. Pat. No. 4,784,601 to Nitta relates to a gas lighter having an L-shaped slideable stopper which is positionable to prevent descent of a gas lever which controls fuel flow. The lighter is rendered operable by moving the stopper outward so that its vertical leg is displaced from the top surface of the lighter housing. The L-shaped slideable stopper must be manually moved into its locking position each time it is desired to lock the lighter.

U.S. Pat. No. 4,784,602 to Nitta relates to a gas lighter having an L-shaped slideable stopper which is positionable to prevent descent of a gas lever which controls fuel flow. The lighter is rendered operable by moving the stopper inward so that its vertical pin engages a hole in the surface of the lighter housing. The L-shaped slideable stopper must be manually moved into its locking position each time it is desired to lock the lighter.

U.S. Pat. No. 4,786,248 to Nitta relates to a piezoelectric lighter equipped with a thumb-latch slideably fitted within a lighter casing. The thumb latch is manually slideable into and out of a position which interferes with depression of a thumb-pusher. The lighter is rendered operable by manually sliding the thumb-latch to an unlocked position. After operation of the lighter a user must manually slide the thumb-latch to its locked position in order to lock the lighter.

U.S. Pat. No. 4,904,180 to Nitta relates to a piezoelectric lighter equipped with a lock means which automatically returns to a locked position after use of the lighter. The lock means includes a stopper and a leaf-spring which keeps the stopper urged toward the windshield. The lighter may only be operated after the stopper is drawn backwards, away from the windshield. The lighter cannot maintain the stopper in the drawn back position without the application of constant force by a user. That is, no means are provided to maintain the lighter in an unlocked configuration.

U.S. Pat. No. 1,895,032 to Fisher relates to a lighter in which a manual control means is movable out of engagement with a shoulder portion of the lighter so as to enable the manual control means to be depressed thereby causing the lighter to operate. The control means returns to its position in engagement with the shoulder portion after use of the lighter. The lighter cannot maintain the control means in its out of engagement position without the application of constant force by a user.

U.S. Pat. No. 4,830,603 to Cirami relates to a cigarette lighter in which a locking mechanism is provided partially under a valve-actuating push-button and extends into a compartment appended to but distinct from a fuel compartment. The locking mechanism relocks itself after each depression of the push-button. In particular, one end of a stiffly flexible spring steel wire is held firmly in place in the compartment. Another end of the spring steel wire forms a probe extending into a channel provided in the underside of the push-button. The spring steel wire, in a locked configuration, prevents depression of the push-button by engaging a low ceiling on the underside of the push-button. A portion of the spring steel wire in the form of a loop extending outward from the lighter is accessible by an operator and may be suitably moved by the operator thereby causing the probe to move within the channel in the underside of the push-button.

U.S. Pat. No. 4,832,596 to Morris, Sr. relates to a cigarette lighter having a stop member slideably mounted thereon for releasably engaging a gas valve actuating lever. In particular, a spring biased stop member is slideably mounted on a top portion of a conventional disposable cigarette lighter. The stop member is biased so as to place one of its ends under the lighter's gas valve actuating lever so as to prevent movement of the lever in a direction which may open the gas valve. The lever may be actuated once the stop member is pushed in a direction opposite to the biasing force of the spring so as to slide the end which is under the lighter's gas valve outward.

U.S. Pat. No. 4,717,335 to Loveless relates to a cigarette lighter in which rotation of a spark-producing wheel is limited. In particular, the spark-producing wheel may be rotated in one direction to deliver a spark toward a nozzle through which gaseous fuel is passed, thereby causing the fuel to ignite and operating the lighter. Rotation of the spark-producing wheel in the other direction may deliver a spark away from the nozzle. The spark-producing wheel has a pin-shaped structure attached thereto which serves to limit the rotation of the wheel to under 360° by contacting the housing structure. Thus, whether a spark indeed is produced depends upon the direction of attempted rotation and the position of the pin-shaped structure relative to the housing structure. In theory, once the lighter is operated and the fuel ignited, and the pin-shaped structure has traversed its entire path of travel, subsequent operation of the lighter is impeded since the pin-shaped structure comes into contact with the housing, preventing a spark from occurring in the vicinity of the fuel nozzle.

U.S. Pat. Nos. 4,028,043 and 4,049,370 each to Neyret relate to presale tamper protection mechanisms which partially surround a spark-producing wheel, fuel nozzle or depressible valve actuation member of a lighter. These presale tamper protection mechanisms are attached to the lighter housing by frangible webs and are removed by a purchaser after sale of the lighter to expose the spark-producing wheel, fuel nozzle and/or depressible valve actuation member. However, such a presale tamper protection mechanism is of limited value once initially removed by a purchaser.

U.S. Pat. Nos. 3,547,566 to Tamarin and 3,899,286 to Lockwood et al. relate to lighters having orientation sensing mechanisms which hinder or prevent actuation of the lighter in an inverted position. Unfortunately, such mechanisms may not provide a sufficient degree of child resistancy to young children who tamper with the lighter since they merely hinder operation in prescribed orientations.

U.S. Pat. No. 4,921,420 to Johnston relates to a disposable lighter having a release means that is physically separated from the conventional lighting means. The lighter may only be operated once the release means is released. The distance separating the release means and the conventional lighting means is intended to be sufficiently large so as to make it difficult for small children to operate the lighter.

U.S. Pat. No. 5,074,781 to Fujita relates to a cigarette lighter having a lock member which must be rotated in a specified direction towards one side of the lighter so as to allow a depressible valve actuator to be depressed and the lighter to operate.

U.S. Pat. No. 5,076,783 to Fremund relates to a lighter having a depressible valve actuator which is coupled to a vertical rod which extends to an opposite end of the lighter where it contacts a locking member. The locking member must first be displaced so as to enable depression of the valve actuator.

U.S. Pat. No. 5,090,893 to Floriot relates to a lighter having a slide member which, when in a first position, prevents depression of a valve actuator. The slide member is slideably movable to a second position in which the valve actuator may be depressed. The slide member is retained in each of the first and second positions by its interaction with and configuration relative to the lighter housing. The slide member is initially moved from its second position toward its first position by forces applied directly from the valve actuator. The slide member is not capable of vertical movement. Additionally, the slide member protrudes from the lighter when in its first position.

Many mechanisms which are designed to render operation of the lighter more difficult by certain users are unnecessarily complicated, present difficulty in their manufacture and/or exhibit a high likelihood of mechanical failure during use. Another disadvantage found in some devices is that the particular construction employed limits the shape and size of the lighter housing due to the requirement that the housing be large enough to accommodate such mechanism(s). Further disadvantages relate to the relative ease with which some mechanisms may be defeated and to the reliability of the mechanisms. For example, some mechanisms may be overridden or removed with relative ease. Additionally, some devices are not equally adaptable for use by both right-handed and left-handed users, and some include inconveniently shaped or positioned levers or knobs which need to be actuated by the user in order to operate the lighter. Similarly, some devices which may indeed be equally adaptable to both right-handed and left-handed users employ a mechanism which is actuated differently and/or moved to different positions depending on whether the user is right-handed or left-handed. Furthermore, some of these devices require repositioning of the lighter in an operator's hand after actuation of the mechanism and before the lighter is operated to produce a flame. For example, some lighters include an actuatable mechanism located sufficiently far from a valve actuation means, or on another side of the lighter than the valve actuation means, so as to result in awkward operation of the lighter. Additionally, some devices require an excessive number of components while some devices include components which are configured such as to require an excessive force to actuate a depressible valve actuator. For example, some devices include a latch which requires an excessive amount of force on the valve actuator in order to automatically return the latch to its normally latched position after the lighter is operated. Some devices include a latch having an overly obvious protrusion which is too easily moved into a noninterfering position. Additionally, a portion of such a latch or protrusion is too easily broken off or otherwise removed by a user, thus rendering the lighter either permanently locked and inoperable, or rendering the latch effectively in a permanent unlocked position and thus permanently overridden.

Although it is known to prevent or hinder presale actuation of a depressible valve actuation member or actuation of a lighter in a specified orientation, none of the above-described lighters provides an efficiently manufacturable, relatively small, reliable mechanism for preventing actuation of the depressible valve actuation member and equally adaptable for use by both right-handed and left-handed users and which is similarly actuated by both right-handed and left-handed users.

As will be appreciated, development of a "child-proof" lighter per se is probably not viable. At best, it can be reasonably sought to create a lighter having features which enhance its child-resistant capability, but how "child-resistant" a lighter will be will depend upon many factors and circumstances. Nevertheless, any lighter having features which enhance its child-resistant capability will have limitations with respect to young children, and no such lighter should provide parents or adults with a false sense of security so that they may become less cautious in their handling of the lighter or permit access to the lighter by young children. Further, such lighters should not be made so difficult to light as to cause adults to use alternative forms of lighting, i.e., matches, which are generally considered to be potentially more dangerous.

The present invention is directed toward a reliable flame producing lighter which is selectively actuatable in such a manner as to provide a substantial degree of difficulty for young children—younger than five years—to actuate the lighter and produce a flame, while being user friendly and capable of actuation by adults.

SUMMARY OF THE INVENTION

This invention relates to a selectively actuatable flame producing lighter having a latch means comprising a latch which is normally in a latched position and which is movable to an unlatched or non-interfering position in which the lighter may be operated. The latch is preferably relatively flush mounted with respect to the lighter housing when in its normally latched position, and does not include portions or protrusions which are easily removed or overly capable of inadvertent movement to a non-interfering position. Additionally, the latch is preferably not under any loading or stress when in its latched as well as unlatched position, and is retained in such positions by its interaction with and configuration relative to the valve actuator. Once in its unlatched position, depression of the valve actuator results in downward movement of part of the actuator as well as the latch. The latch is preferably initially moved from its unlatched position toward its latched position by forces applied directly from a camming means associated with the lighter housing.

Advantageously, the latch may be operated with the same finger a user employs to depress a valve actuation lever, without requiring repositioning of the lighter in a user's hand. The lighter is adapted for use by right-handed as well as left-handed users with the same relative ease. The lighter is preferably similarly actuated by both right-handed and left-handed users, without detracting from the effectiveness of the lighter's child-resistant capability. That is, the latch is preferably movable along only a single path from its latched position to its unlatched position, whether operated by right-handed or left-handed users.

One particular embodiment of the invention relates to a flame producing lighter which comprises a housing defining a reservoir for containing a combustible gaseous medium such as fuel under pressure; valve means arranged for selective actuation between a normally closed position which prevents exit of the gaseous medium from the reservoir, and an open position which permits exit of gaseous medium from the reservoir through the valve means; means for selectively producing sparks at a location proximate the gaseous medium exit opening of the valve means thereby selectively causing ignition of the gaseous medium; means normally positioned for preventing actuation of the valve means to the open position, the valve actuation prevention means being incapable of vertical movement when in its normal position and being movable out of its normal position inward into a second position only by application of an external force, where it is capable of vertical movement; means for selectively moving the valve actuation prevention means to the second position whereby actuation of the valve means to the open position is permitted thereby selectively permitting exit of the combustible gaseous medium from the valve means and ignition of the gaseous medium by sparks produced by the spark producing means, wherein the valve actuation prevention means automatically returns to the normal position after actuation of the lighter. The lighter preferably includes means to retain the valve actuation prevention means in the second position, thus retaining the lighter in an unlatched configuration. Such retention means may include portions of the housing and/or portions of the valve actuation prevention means and/or portions of the valve actuator. Additionally, the valve actuation prevention means of the lighter is preferably constrained to move along only a single path from its normal, or latched, position to the second, or unlatched, position. The valve actuation prevention means is preferably under no loading when in each of its latched as well as unlatched positions.

In this embodiment, the valve means is preferably actuated to the open position by actuator means and the means for preventing actuation of the valve means to the open position comprises interference means for preventing movement of the actuator means, the valve actuation interference means being selectively movable to a position out of interference with the valve actuator means. The valve actuation interference means is normally retained in a valve actuation interference position, the movement thereof to the position out of interference with the valve actuator means is resiliently provided. Advantageously, the resilient movement of the valve actuation interference means facilitates the return of the valve actuation interference means to its interfering position once the valve actuator is released, thus preventing the valve nozzle from opening. A camming means such as ramps formed within the housing may also be employed to facilitate the return of the valve actuation interference means to its interfering position. Illustratively, the valve actuation means may be retained in its latched and unlatched positions by its interaction with the actuator means. Additionally, the valve actuation interference means is preferably attached to the valve actuator such as by way of a slideable arrangement.

The valve actuation interference means may take on a variety of forms such as a latch means, a latch or an interference member.

The spark producing means of the lighter preferably includes flint material and a rotatable spark-producing wheel which has a toothed surface positioned and arranged to selectively frictionally contact the flint material. Alternatively, the means for selectively producing sparks may be an electric spark-producing means, such as a piezoelectric spark-producing means.

Another embodiment of the invention relates to a flame producing lighter resistant to unauthorized use and normally maintained in a latched configuration comprising a housing; fuel supply means for supplying fuel to be ignited; ignition means for igniting the fuel; valve means for controlling the flow of the fuel; a valve actuator which normally prevents the flow of the fuel when in a first position and is depressible to a second position which permits actuation of the fuel supply means thereby permitting fuel to flow out from the fuel supply means; and a latch positioned so as to normally prevent depression of the depressible valve actuator and normally maintain the lighter in the latched configuration. For example, the latch may include at least a portion normally positioned between at least a portion of the valve actuator and at least a portion of the housing.

In this embodiment, inward movement of the latch enables a tip portion of the latch to become aligned with a cavity in or near the housing, the cavity being sufficient in size to accommodate the tip portion so as to eventually enable the valve actuator and the latch to be depressed.

Such inward movement of the latch places the lighter in an unlatched configuration in which the valve actuator is capable of being depressed, thereby permitting fuel to flow. Preferably, the unlatched configuration is maintained until the valve actuator is depressed.

Another embodiment of the lighter employs means for preventing movement of the actuator means, such prevention means having a finger actuatable portion and an interfering portion, the interfering portion being normally in alignment with an interfering portion of the housing thereby preventing movement of the actuator means, the finger actuatable portion being selectively movable so as to move the interfering portions out of alignment with each other, such movement being resiliently provided so as to facilitate the return of the interfering portions into alignment with each other when the valve actuator is released, thus preventing the valve nozzle from opening.

Another embodiment of the invention relates to a fuel cut-off mechanism for use in combination with a lighter which comprises means for normally preventing actuation of a fuel supply; means for selectively permitting actuation of the fuel supply including a depressible valve actuator which upon depression actuates the fuel supply thereby permitting fuel to flow out from the fuel supply; and a latch which normally interferes with depression of the depressible valve actuator, the latch being arranged such that inward movement of the latch provides a void sufficient in size to enable depression of the valve actuator and downward movement of the latch wherein fuel is permitted to flow.

The present invention also relates to an improved lighter of the type having valve means for selectively releasing fuel, means for igniting the fuel, valve actuator means for actuating the valve means so as to release fuel, the valve means including a fuel nozzle which expels fuel when the fuel nozzle is lifted upward by the valve actuator means, wherein the improvement comprises a compensator spring which maintains the fuel nozzle in its downward position when the value actuator is initially actuated. The compensator spring is preferably positioned between the valve actuator means and a portion of the fuel nozzle so as to urge the fuel nozzle downward. The compensator spring is preferably a metallic coiled spring. The fuel nozzle is preferably normally biased downward by the valve actuator means.

In another embodiment, such lighter includes interference means positioned so as to normally interfere with actuation of the valve actuator means, and the compensator spring means compensates for movement of the valve actuator means when the interference means is normally positioned so as to interfere with the actuation of the valve actuator means.

Operation of the lighter requires a certain amount of dexterity and the application of concentrated forces as well as the application of a plurality of forces in multiple directions and in a specified sequence. Additionally, operation of the lighter requires a certain level of cognitive ability.

Furthermore, the lighter of the present invention is a passive latching lighter. Advantageously, the lighter automatically returns to its latched configuration once the depressed valve actuator is released. Thus, the lighter is maintained in an at-rest or default configuration which is latched thereby preventing the flow of fuel and the production of a flame.

Advantageously, the lighter is adapted for use by right-handed as well as left-handed users with the same relative ease, and is similarly actuated by both right-handed and left-handed users. Furthermore, the user may operate the latch mechanism with the same finger as used to depress the valve actuator without requiring the user to reposition the lighter in the user's hand.

BRIEF DESCRIPTION OF THE DRAWINGS

These and other objects, features, and advantages of the present invention will become more readily apparent from the following detailed description of the invention in which.

DETAILED DESCRIPTION OF THE PREFERRED EMBODIMENT

Figure 1:
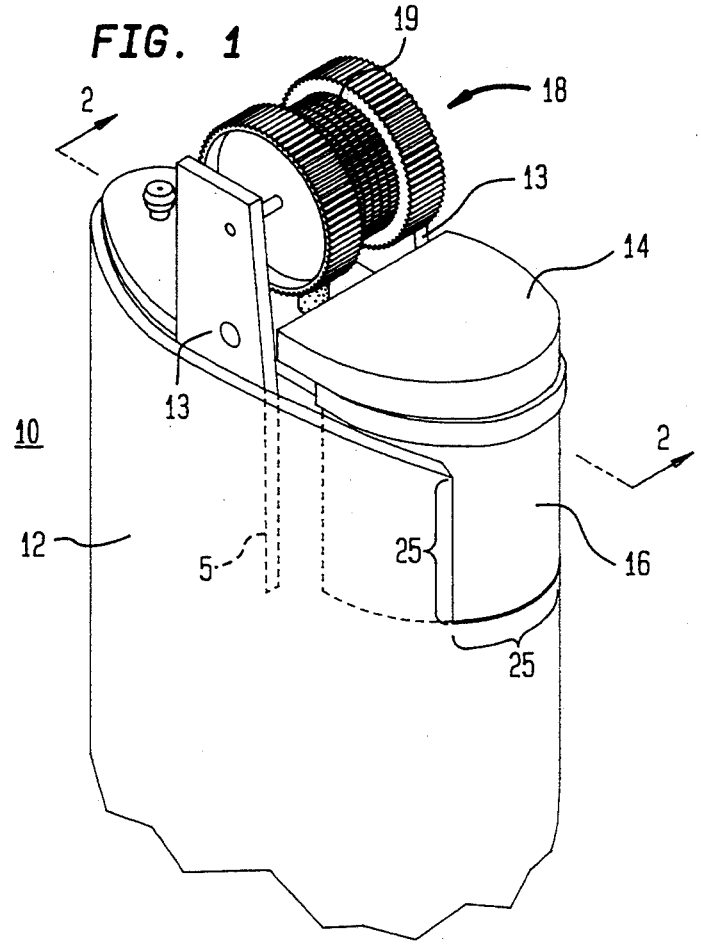
FIG. 1 is a partial perspective view of a preferred embodiment of a selectively actuatable lighter of the present invention in a latched configuration.

Referring initially to FIG. 1, there is depicted, in a default or at-rest configuration, the lighter 10 of the present invention comprising a main body portion 12, a depressible valve actuator 14, latch 16, and a spark-producing wheel assembly 18 which includes a toothed surface 19. Advantageously, the default configuration is also a latched configuration in which valve actuator 14 cannot be depressed due to the interference presented by latch 16. Depression of valve actuator 14 permits fuel to flow through a fuel nozzle and to be ignited by sparks produced by toothed surface 19 of spark-producing wheel assembly 18 frictionally engaging a flint. Advantageously, unless latch 16 is positioned away from its depicted at-rest or default position and into a non-interfering position, any attempted depression of valve actuator 14 will not result in the flow of fuel and the lighter will be inoperable. The position of latch 16 as shown in FIGS. 1 and 2 may best be characterized as a "default position" under normal conditions.

As will be appreciated, a variety of configurations, shapes and relative positioning exists for the valve actuator and the latch means in which the latch is movable, with respect to the valve actuator, between an interfering or latched position and a non-interfering or unlatched position. The invention will be described in terms of a preferred embodiment in which an illustrative latch normally interferes with depression of the valve actuator when in a latched position, and is movable to an unlatched position in which the valve actuator may be depressed. Preferably, the latch is moved from its latched position to its unlatched position along a single path, which is equally suitable for right-handed as well as left-handed users. Such movement is illustratively in an inward direction. As will be appreciated, for ease of understanding, such inward motion of the latch is deemed to include any inward motion or component thereof of any portion of the latch. The latch is preferably maintained in its unlatched position after being moved there by a user, and preferably automatically returns to its latched position once a user depresses and releases the valve actuator.

A user typically holds the main body portion of a conventional lighter in his hand, rotates with his thumb the spark-producing wheel in a direction generally toward the depressible surface of the valve actuator to produce a spark, and depresses the valve actuator to allow fuel to pass through the fuel, or valve, nozzle. The spark produced by the wheel ignites the fuel. This is a relatively conventional structure for most lighters, including disposable lighters.

Figure 2:
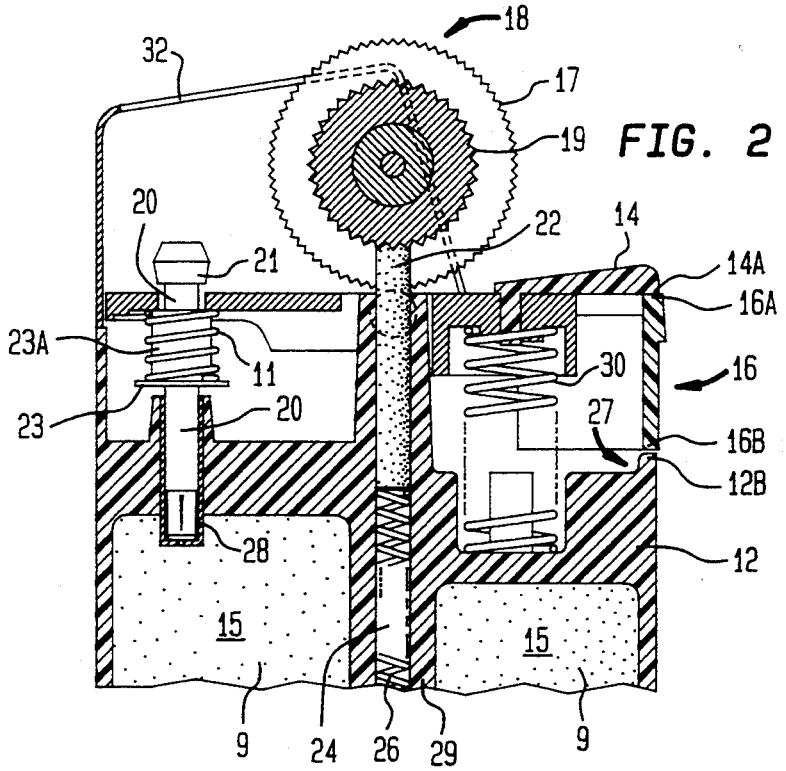
FIG. 2 is a partial cross-sectional view of the lighter of FIG. 1 depicting the latch in a latched configuration.

Referring now to FIG. 2, there is depicted a cross-section of the lighter of FIG. 1 in a latched configuration. More particularly, valve actuator 14 is mounted between side wall portions 13 (see FIG. 1) which illustratively comprise extensions of the side walls of body portion 12. Illustratively, valve actuator 14 is pivotally mounted to sidewall portions 13. Valve actuator 14 is attached to hollow fuel nozzle 20 slideably supported within a valve housing 28. Hollow fuel nozzle 20 is held within an opening such as a bore in valve actuator 14 by flange 21, compensator spring means 11 and flange extension 23A. Flange 21 and flange extension 23A each has a sufficient size and is configured so as to prevent slippage of nozzle 20 through the bore in valve actuator 14. Additionally, spring means 11 is maintained as shown in FIG. 2 by flange 23 which is attached to fuel nozzle 20 as is flange 21. A compressed spring means 30 resides beneath valve actuator 14 and causes fuel nozzle 20 to be urged downward into valve housing 28 and body portion 12. In particular, compressed spring 30 causes valve actuator 14 to apply force to spring means 11 which supplies force to flange 23, thereby urging nozzle 20 downward into valve housing 28 and body portion 12 and preventing the flow of fuel through nozzle 20. Additionally, downward movement of valve actuator 14 in the vicinity of nozzle 20 is limited by contact between the underside of valve actuator 14 and flange extension 23A. In such an embodiment, valve actuator 14 is employed to lift nozzle 20 by the application of force to flange 21 in order to expel fuel. A valve assembly (not fully shown) is located near the recessed end of nozzle 20 and permits fuel to flow through nozzle 20 only when valve actuator 14 is depressed and nozzle 20 lifted.

As will be appreciated, actuation of valve actuator 14 generally results in upward movement of the valve actuator in the vicinity of nozzle 20. However, in the embodiment depicted in FIG. 2, nozzle 20 remains downward during the initial upward movement of valve actuator 14 in the vicinity of nozzle 20 due to the action of compensator spring 11. More specifically, nozzle 20 only moves upward once the valve actuator in the vicinity of nozzle 20 moves upward a sufficient amount such that a top surface of valve actuator 14 in the vicinity of nozzle 20 contacts flange 21. Advantageously, depression of the valve actuator while the lighter is in a latched configuration, while possibly causing the valve actuator in the vicinity of nozzle 20 to move upward due to, for example, a gap between valve actuator interfering portion 16B and housing interfering portion 12B, will not result in any upward movement of the fuel nozzle. Accordingly, fuel will not be released in the event the valve actuator is depressed while the lighter is in a latched configuration. As will be appreciated, such use of a compensator spring is desirable in lighters which incorporate a gap allowing some depression of a latched valve actuator which would otherwise release fuel due to such depression.

Lighter 10 further comprises a sparking flint 22 mounted within a bore 24 defined by flint and spring housing 29 in main body 12. Flint 22 is urged toward toothed surface 19 of wheel assembly 18 by spring 26. Spark-producing wheel assembly 18, which includes toothed surface 19 which is preferably suitably hardened and against which flint 22 is urged, is mounted for rotation between side wall extension portions 13 in a conventional manner. Toothed surface 19 includes suitable indentations which define teeth such that when spark-producing wheel assembly 18 is rotated toothed surface 19 cuts against flint 22 causing the generation of ignition sparks. Additionally, spark-producing wheel assembly 18 includes suitable indentations 17 which facilitate rotation of spark-producing wheel assembly 18 by an operator's finger.

Main body 12 defines an internal chamber 15 which is filled with a fuel 9 such as butane fuel capable of vaporizing in a conventional manner to produce a gaseous medium which passes through fuel nozzle 20 under the control of a valve. Main body 12 is constructed from any suitable structural material or materials, and is preferably constructed from a plastic material. A shield 32, preferably constructed from metal, is provided and functions as a wind guard around the flame thereby assisting in the ignition of the fuel.

As will be appreciated, main body 12 generally encompasses any part, portion, structure or substructure of the lighter except for the valve actuator and spring, spark producing wheel assembly, flint and spring, valve assembly, and latch means. Accordingly, what will be described as housing interfering portion 12B is deemed to include any such part, portion, etc.

As depicted in FIG. 1 and 2, a notched opening 25 is provided in body portion 12 to accommodate valve actuator 14 and latch 16 and, in particular, vertical movement of valve actuator 14 and inward as well as vertical movement of latch 16. As will be appreciated, FIGS. 1 and 2 depict the lighter in a latched configuration, i.e., a default configuration. In this latched configuration, latch 16 is positioned between valve actuator 14 and housing 12 and prevents depression of valve actuator 14, thereby preventing actuation of the valve means and thus the release of fuel.

Referring again to FIG. 2, latch 16 is depicted in its latched configuration in which an interfering portion 16A of latch 16 is positioned and configured so as to interfere with and prevent depression of valve actuator 14. More specifically, an interfering portion 14A of valve actuator 14 contacts interfering portion 16A of latch 16 upon attempted depression of valve actuator 14, thus preventing the release of fuel from fuel nozzle 20. In its latched configuration, latch 16 is prevented from any downward travel by the contact between interfering portion 16B of latch 16 and interfering portion 12B of main body 12. Alternatively, any such downward travel of valve actuator 14 may be prevented by another portion of latch 16 contacting another portion of body 12 or another portion of latch 16 contacting another portion of valve actuator 14. As will be discussed in conjunction with FIGS. 3–8, latch 16 is movable inward to mate with valve actuator 14 whereupon latch interfering portion 16B is no longer aligned with housing interfering portion 12B thus enabling depression of valve actuator 14 and downward movement of latch 16 at least partially into a notch or cavity 27 suitably shaped for receiving a portion of latch 16 including a tip portion which in turn includes interfering portion 16B. Preferably, cavity 27 is shaped so as to accommodate the tip portion of latch 16, including interfering portion 16B. A user desiring to actuate the lighter must first force the tip portion of latch 16, and thus interfering portion 16B, out of interference with interfering portion 12B of body 12. This is accomplished by a user moving latch 16 inward such that interfering portion 16B is moved into alignment with cavity 27. Specifically, a user applies a component of force to a finger actuatable portion 16C of latch 16 so as to force its tip portion inward and into alignment with cavity 27. As will be discussed in conjunction with FIGS. 3–8, once a user moves latch 16 sufficiently inward, the latch will remain inward in its unlatched position until a user depresses and releases the valve actuator.

Figure 3:
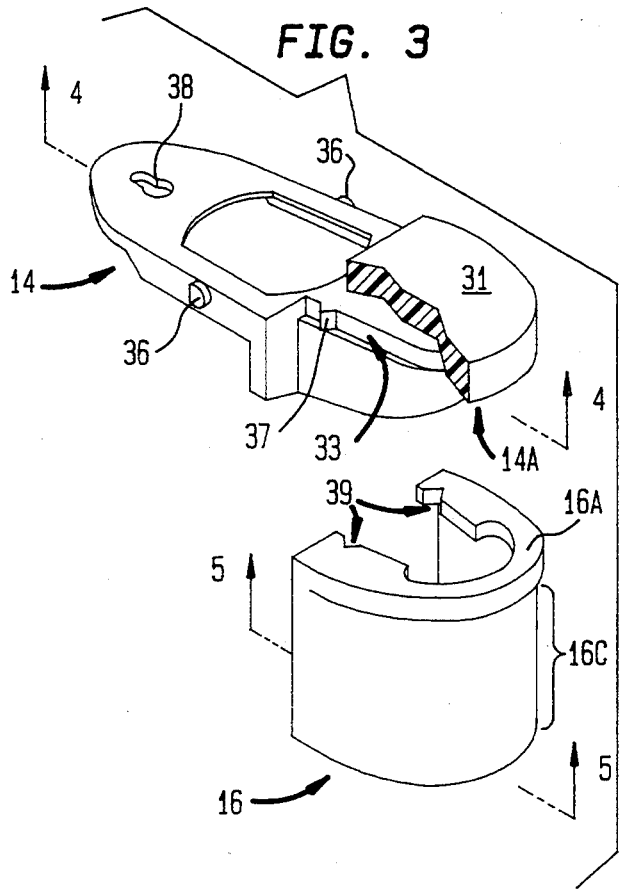
FIG. 3 is an exploded view of the valve actuator and latch depicted in FIGS. 1 and 2.

Referring now to FIG. 3, there is depicted valve actuator 14 and latch 16 in greater detail. Valve actuator 14 comprises a finger depressible surface 31, extensions 36, a nozzle opening such as a bore 38, and valve actuator mating structure 37 (see FIGS. 4, 6–8). Such mating structure illustratively comprises two protrusions, one located on each of two sides of the valve actuator. Extensions 36 are provided to matingly engage with bores in side wall portions 13 of body portion 12 to provide pivotal movement of the valve actuator about extensions 36. Bore 38 is adapted for receiving and grasping a portion of fuel nozzle 20 between flanges 21 and 23.

Valve actuator 14 is constructed from material having sufficient dimensional stability and rigidity to continuously over the life of the lighter assure proper relative positioning between interfering portion 14A of valve actuator 14 and interfering portion 16A of latch 16. Actuator 14 is preferably constructed from zinc or glass-filled polyetherimide. Other illustrative materials from which valve actuator 14 may be constructed are aluminum and other glass filled polymers such as polyethersulfone or the like, as well as combinations of these materials.

Latch 16 includes latch mating structure 39. Such mating structure is shaped, configured, positioned and adapted to releasably mate (i.e. engage and disengage) with valve actuator mating structure 37. Illustratively, such latch mating structure comprises two indentations, one located on respective inner surfaces of each of two sides of the latch.

As will be appreciated, mating structures 37 and 39 may take on a variety of shapes, positions and configurations. Their specific structure is not critical to the present invention. Additionally, each of structures 37 and 39 can comprise any reasonable number (including one) of separate structures. For example, valve actuator mating structure 37 may comprise the embodiment depicted in FIGS. 3–8, while latch mating structure 39 may comprise four indentations, two located on respective inner surfaces of each of two sides of the latch. In such an embodiment, valve actuator mating structure 37 would engage with two indentations of latch mating structure 39 when in a latched configuration as well as when in an unlatched configuration. As will be described in conjunction with FIGS. 6–8, one preferred embodiment of the lighter will have structure 37 mating with structure 39 when the lighter is in its unlatched configuration.

Latch 16 is preferably constructed from relatively rigid and somewhat flexible material which is sufficiently resilient to permit temporary widening of the distance between the two indentations of mating structure 39 so as to engage and disengage from structure 37 of the valve actuator during movement of latch 16 between its latched position and its unlatched position. Latch 16 is preferably constructed from any sufficiently resilient plastic or metal, although a wide variety of other suitable materials having a sufficient degree of rigidity and elastic memory may be employed.

In the latched or closed configuration (FIGS. 1 and 2), an upper surface of interfering portion 16A of latch 16 abuts a lower surface of interfering portion 14A of valve actuator 14, and a lower surface of interfering portion 16B of latch 16 abuts an upper surface of interfering portion 12B of body 12, thereby preventing depression of valve actuator 14. Alternatively, a small gap (FIGS. 1 and 2) may be provided such as between the lower surface of interfering portion 16B of latch 16 and the upper surface of interfering portion 12B of latch 12.

Referring again to FIG. 3, latch 16 is slideably attached to valve actuator 14 by way of groove 33 formed in actuator 14. Such slideable attachment, as well as the relative shapes and configurations of groove 33 and the portion of latch 16 which slides within groove 33, enables latch 16 to move outward relative to valve actuator 14, but prevents vertical movement of latch 16 relative to valve actuator 14.

Figure 4:
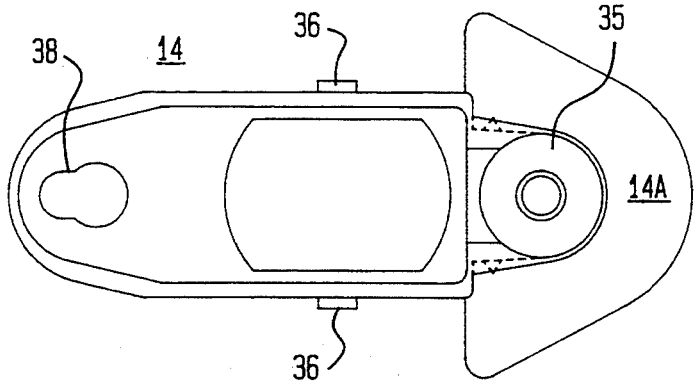
FIG. 4 is a bottom view of the valve actuator depicted in FIG. 3.

Referring now to FIG. 4, there is depicted a view of the underside of valve actuator 14 of FIG. 3. A portion 35 of valve actuator 14 is adapted to receive spring 30 as depicted in FIG. 2 and may take on a variety of forms such as a protruding member or, alternatively, an indentation or bore partially into valve actuator 14. The fuel nozzle is illustratively maintained in bore 38 by fuel nozzle flanges 21 and 23 and spring means 11 (FIG. 2) which have a diameter greater than that of a corresponding portion of bore 38.

Figure 5:
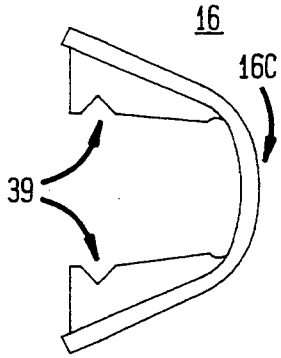
FIG. 5 is a bottom view of the latch depicted in FIG. 3.

FIG. 5 depicts the underside of latch 16 of FIG. 3. The size, shape, and configuration of latch 16 facilitates retention of the lighter in an unlatched configuration as well as stabilization of latch 16 within the lighter, and assures proper positioning and retention of latch 16 in notched opening 25 especially when the latch is moved. Finger actuatable portion 16C of latch 16 is employed by a user to move the latch and, in particular, to move its interfering portion 16B inward so as to become aligned with cavity 27 of housing 12.

Figure 6:
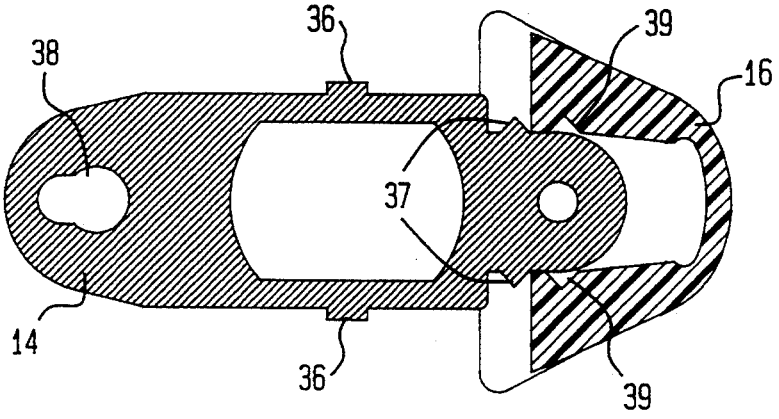
FIG. 6 is a cross-sectional view of the valve actuator and latch depicted in FIG. 3 when in their latched configuration thereby permitting depression and actuation of the valve actuator.
Figure 7:
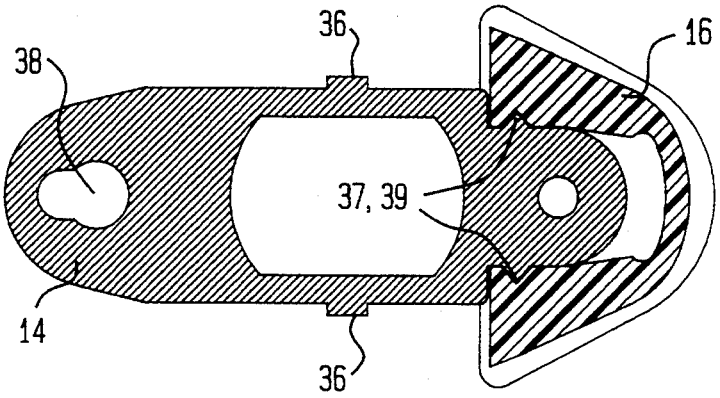
FIG. 7 is a cross-sectional view of the valve actuator and latch depicted in FIG. 3 when in their unlatched configuration thereby permitting depression and actuation of the valve actuator.
Figure 8:
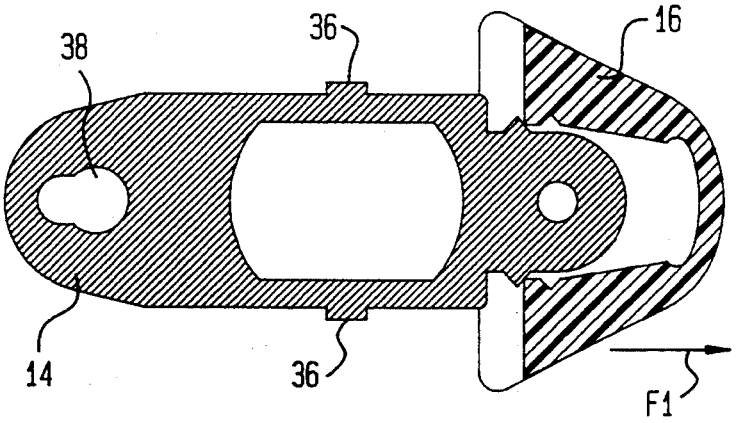
FIG. 8 is a cross-sectional view of the valve actuator and latch depicted in FIG. 3 when in a configuration which is intermediate of the latched and unlatched configurations.

FIGS. 6, 7 and 8 are each cross-sectional views of the valve actuator and latch of FIG. 3 when in their latched (FIG. 6), unlatched (FIG. 7) and intermediate (FIG. 8) configurations. More specifically, FIG. 6 depicts latch 16 in its latched position in which latch mating structure 39 is out of engagement with valve actuator mating structure 37. As will be appreciated, latch 16 is preferably under no loading as it is depicted in FIG. 6.

FIG. 7 depicts latch 16 in its unlatched position in which latch mating structure 39 is in engagement with, or mated with, valve actuator mating structure 37. As will be appreciated, latch 16 is preferably under no loading as it is depicted in FIG. 7.

Advantageously, latch 16 may only be moved from its latched position to its unlatched position by an external force, i.e., a force applied by a user to latch 16. Such force must be sufficient to cause the distance between the two indentations of structure 39 of latch 16 to widen such that structures 37 and 39 engage. Accordingly, absent the application of such force, the lighter of the present invention is normally maintained in its latched configuration.

As will be appreciated, latch 16 is under loading only during the transition between its latched position and its unlatched position. Accordingly, latch 16 may be constructed from a relatively wide choice of materials which do not necessarily have to be able to withstand constant loading. Additionally, due to the relative materials from which valve actuator 14 and latch 16 are constructed, and due to their relative shapes and configurations, only latch 16 is deformed during the transition between its latched and unlatched positions. In the preferred embodiment illustrated in FIGS. 6–8, such deformation comprises a temporary widening of the distance between the two indentations of mating structure 39. Moreover, latch 16 cannot be placed in and maintain a position which is intermediate that of the latched and unlatched positions.

Referring now to FIG. 8, valve actuator 14 and latch 16 are depicted in a configuration which is intermediate the latched configuration of FIG. 6 and the unlatched configuration of FIG. 7. As depicted in FIG. 8, latch 16 is under loading and is temporarily deformed. The configuration depicted in FIG. 8 occurs for a brief period of time as latch 16 is moved from its latched position to its unlatched position, and from its unlatched position to its latched position. As will be appreciated, the configuration depicted in FIG. 8 can not be self-maintained. Specifically, due to the component of force exerted by the valve actuator on the latch, the latch is biased toward the right of FIG. 8, away from the valve actuator and toward its latched position. In other words, latch 16 is squeezed away from valve actuator 14 in the configuration depicted in FIG. 8. Such biasing enables the lighter to automatically return to its latched configuration once the lighter is actuated. Of course, no such biasing exists in the configurations depicted in FIGS. 6 or 7 since latch 16 is not under any loading in its latched (FIG. 6) and unlatched (FIG. 7) positions.

Advantageously, the materials and configurations of valve actuator 14 and latch 16 as well as their shapes cause valve actuator 14 to force latch 16 away from actuator 14 for all positions of the latch between the two extreme positions depicted in FIGS. 6 and 7 thereby biasing the latch into its latched position once it becomes disengaged from the actuator. Additionally, such materials, configurations and shapes facilitate retention of the lighter and, in particular, latch 16, in an unlatched or non-interfering position or configuration once the latch is placed in such an unlatched position or configuration, and until valve actuator 14 is depressed and released.

Figure 9:
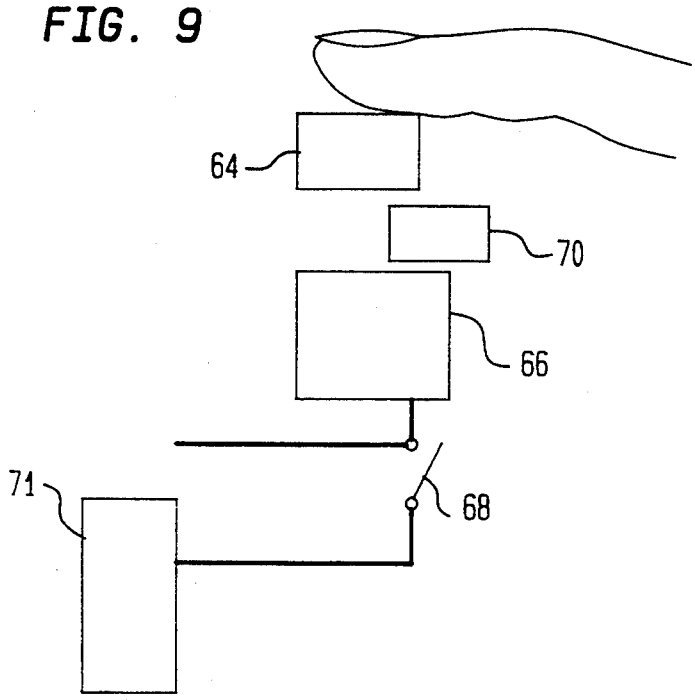
FIG. 9 is a schematic diagram depicting a piezoelectric lighter apparatus in which the present invention may be employed and having an optional switch depicted in the open position and a latch means depicted in the latched position to prevent the production of sparks and the flow of fuel.

FIG. 9 schematically depicts a piezoelectric type lighter in which the present invention may be employed. The piezoelectric lighter comprises hammer and fuel release means 64, spark providing means 66, optional electrical cut-off switch 68, latch means 70 and valve means 71. The piezoelectric lighter operates in a conventional manner except for depression of hammer means 64 which is prevented by inclusion of latch means 70 operative in accordance with the present invention. Illustratively, such latch means comprises a latch which prevents the production of sparks. In particular, latch means 70 may prevent the production of sparks by electrically and/or mechanically isolating an energy source from the spark producing means. Alternatively, the latch means may be arranged to selectively prevent only the flow of fuel or it may be arranged to selectively prevent both the production of sparks and the flow of fuel. As depicted in FIG. 9, the lighter is in a latched configuration since latch means 70 is positioned so as to prevent actuation of hammer means 64. Additionally, switch 68 is depicted in an open, or off, position. As will be appreciated, incorporation of optional switch 68 requires that it be closed and that latch means 70 be unlatched in order for fuel to be ignited.

Figure 10:
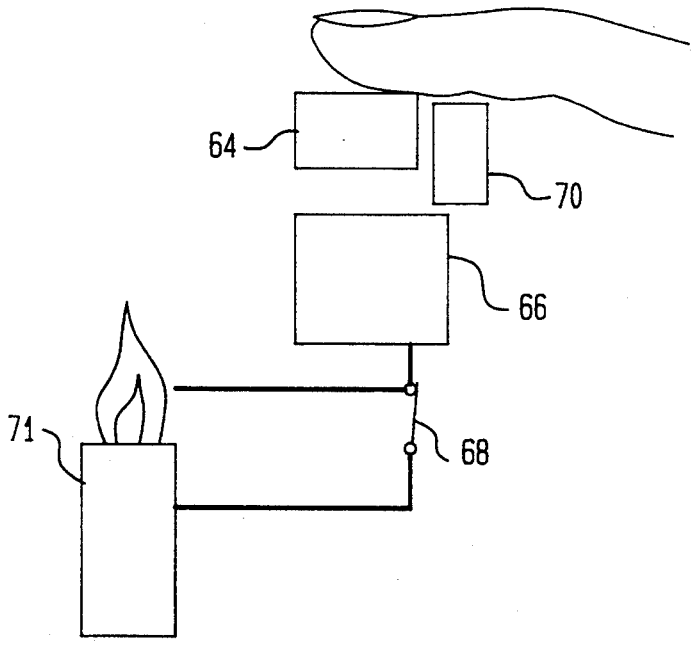
FIG. 10 is a schematic diagram depicting the piezoelectric lighter of FIG. 9 with the switch depicted in the closed position and the latch means depicted in the unlatched position and depicting a flame.

FIG. 10 schematically depicts the piezoelectric type lighter of FIG. 9 in an unlatched configuration. In particular, latch means 70 is positioned so as to enable actuation of hammer means 64. Additionally, switch 68 is depicted in a closed, or on, position. As will be appreciated, incorporation of optional switch 68 requires that it be closed and that latch means 70 be unlatched in order for fuel to be ignited.

Figure 11:
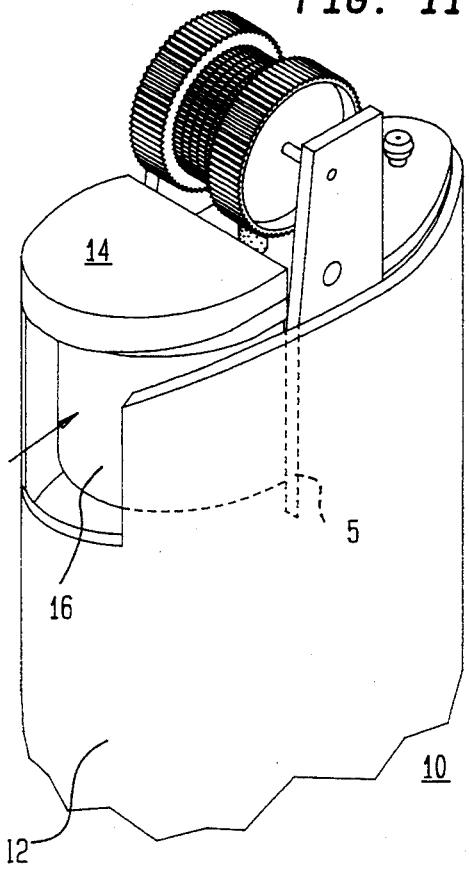
FIG. 11 is a perspective view of a preferred embodiment of the lighter in an unlatched configuration in which the latch is at its unlatched position thereby permitting depression of the valve actuator so as to permit a valve to open and gas to be released through a fuel nozzle.
Figure 12:
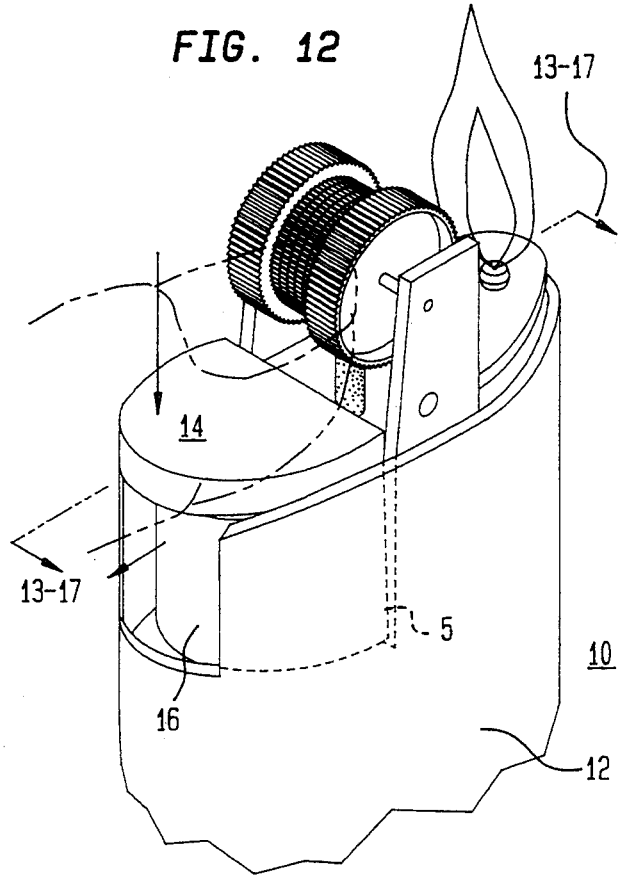
FIG. 12 is a perspective view of the lighter of FIG. 11 with the valve actuator in a depressed position and the valve open and depicting a flame.

Advantageously, the present invention automatically returns the latch to its latched position after the lighter has been activated and, in particular, after the valve actuator has been depressed and released. The biasing force described in conjunction with FIG. 8 facilitates such automatic return, as does a camming means 5 which is depicted in FIGS. 1, 11 and 12 as a ramp on each side of the lighter. The ramps are preferably integrally formed with housing 12. Such automatic return will now be further described in conjunction with FIGS. 1, 11 and 12.

In operation of the present invention, and as depicted in FIGS. 1, 11 and 12, a user must first move latch 16 in an inward direction (FIG. 11) so as to sufficiently displace interfering portion 16B of latch 16 out of interference with interfering portion 12B of housing 12, and at least partially align interfering portion 16B of latch 16 with cavity 27 in housing 12 so as to ultimately permit depression of valve actuator 14 and downward movement of the latch. In order to facilitate retention of latch 16 in a non-interfering position, latch 16 is displaced sufficiently inward such that latch structure 39 engages valve actuator structure 37. (see also FIGS. 6–8).

Additionally, once the latch is displaced so as to cause structures 37 and 39 to engage, a portion of the latch will abut or approximately abut the camming means, as best seen in FIG. 11. Accordingly, camming means 5 may also function as a stop member to limit the inward movement of latch 16 and provide feedback to a user. Such displacement of latch 16 places the lighter in an unlatched configuration as depicted in FIG. 11. Depression of valve actuator 14 at this point and suitable rotation of the spark-producing wheel assembly 18 will cause the lighter to operate, and will also cause valve actuator 14 as well as latch 16 to travel downward as indicated in FIG. 12. In particular, the sparks thus produced will ignite the gaseous fuel which is permitted to be expelled from the fuel nozzle when valve actuator 14 lifts the nozzle thereby actuating the valve. The lifting action of valve actuator 14 in a vicinity near the nozzle releases fuel from the fuel chamber thereby permitting the flow of fuel as a gaseous medium through the nozzle and the subsequent burning of such fuel.

Additionally, depression of valve actuator 14 causes latch 16 to disengage from valve actuator 14 and thus move outward toward its latched position. More specifically, as valve actuator 14 forces latch 16 downward, camming means 5 forces latch 16 outward relative to valve actuator 14. Accordingly, such downward movement forces latch structure 39 to disengage from actuator structure 37, and latch 16 to move outward toward its latched position. Additionally, and as described in conjunction with FIGS. 6–8, the outward movement of latch 16 is also due to the relative shapes, materials and configurations of valve actuator 14 and latch 16 which cause valve actuator 14 to force latch 16 outward. The outward movement of latch 16 from its unlatched position (FIG. 11) to its latched position (FIG. 1), in the preferred embodiment, may generally be considered to be initially due to camming means 5 which serves to disengage latch 16 and actuator 14, and then due to forces exerted by actuator 14 onto latch 16.

Thus, the presently preferred embodiment of the invention may be placed in an unlatched configuration from its default latched configuration by sufficiently displacing interfering portion 16B relative to interfering portion 12B. This may be accomplished by moving interfering portion 16B into engagement or alignment with cavity 27 thereby causing latch structure 39 to engage valve actuator structure 37. Advantageously, the path defined by such movement is the same for right-handed and left-handed users, and each of such users may unlatch the lighter with the same relative ease. Thus, the lighter of the present invention enables every user, whether right-handed or left-handed, to actuate the lighter by suitably urging the latch out of interference with the lighter body, and does not require separate paths or structures to accommodate right-handed and left-handed users.

More specifically, by providing a single path for latch 16 to follow as the lighter is reconfigured from the latched configuration to the unlatched configuration, which path does not favor either of right-handed or left-handed users more than the other, although both such users employ the same path, such users will feel equally comfortable in actuating the lighter without detracting from the effectiveness of the lighter's latch.

Figure 13:
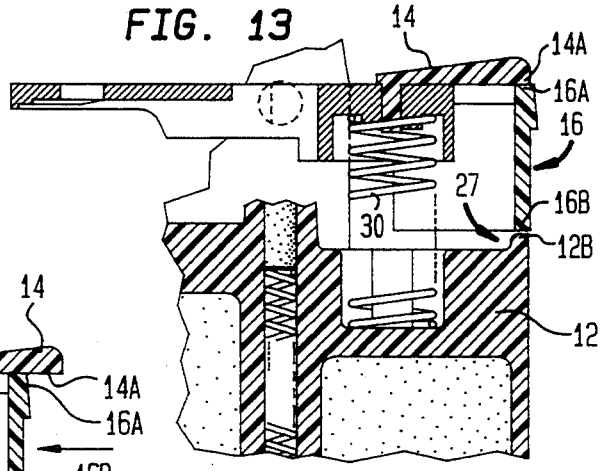
FIG. 13 is a partial cross-sectional view of the preferred embodiment of the lighter in its latched configuration thereby preventing depression and actuation of the valve actuator.

FIGS. 13–17 depict the sequence of operations required for the unlatching of the lighter by positioning interfering portion 16B in cavity 27 of housing 12. In particular, FIG. 13 depicts latch 16 and valve actuator 14 in the default or latched configuration. As will be appreciated, each of FIGS. 6 and 13 depict the latch and the valve actuator in the same latched configuration. In this configuration, depression of valve actuator 14 by finger pressure on surface 31 is prevented by the contact between interfering portion 14A of valve actuator 14 and interfering portion 16A of latch 16 as well as the contact between interfering portion 16B of latch 16 and interfering portion 12B of housing 12. As depicted in FIG. 13, valve actuator 14 and latch 16 are prevented from any further downward movement since interfering portion 16B of latch 16 abuts interfering portion 12B of body 12, except for a small gap thereinbetween. For ease of illustration, the gap between portions 16B and 12B in the figures is not necessarily drawn to scale. Additionally, such a gap is not necessary for proper operation of the invention.

Figure 14:
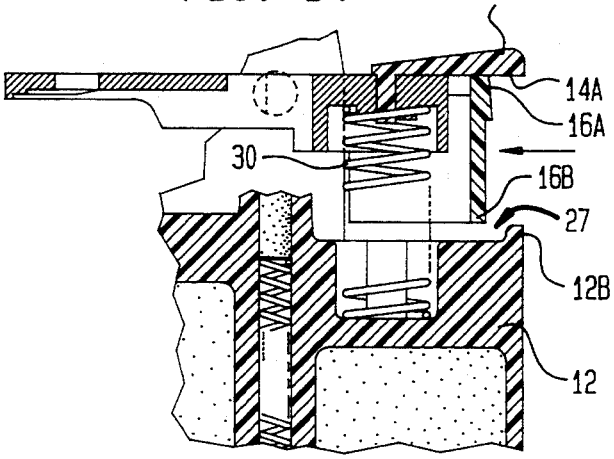
FIG. 14 is a partial cross-sectional view of the lighter of FIG. 13 in its unlatched configuration and the valve actuator not depressed and the lighter ready for actuation.

FIG. 14 depicts latch 16 and valve actuator 14 in an unlatched configuration ready for depression of valve actuator 14. As will be appreciated, each of FIGS. 7 and 14 depict the latch and valve actuator in the same unlatched configuration. Latch 16 including its interfering portion 16B have been moved inward as indicated by the arrow into alignment with cavity 27 which is illustratively formed in housing 12. Advantageously, due to the engagement of valve actuator mating structure 37 with latch mating structure 39 (FIG. 7) when latch 16 is moved sufficiently inward, removal of holding pressure from finger actuatable portion 16C will not result in latch 16 slipping toward its latched position but will maintain the lighter in the unlatched configuration depicted in FIG. 14, until valve actuator 14 is depressed. In other words, the lighter may be readied for actuation and flame production by applying suitable force to finger actuatable portion 16C to move latch 16 including interfering portion 16B in an inward direction so as to cause valve actuator mating structure 37 to engage latch mating structure 39 thereby placing interfering portion 16B into alignment with cavity 27.

Figure 15:
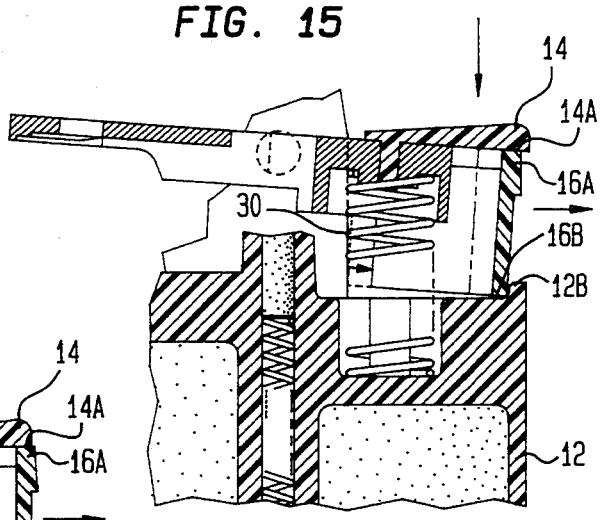
FIG. 15 is a partial cross-sectional view of the lighter of FIG. 14 in its partially unlatched configuration and the valve actuator fully depressed so as to permit the flow of fuel.

Application of finger pressure to the finger depressible surface of valve actuator 14 as depicted in FIG. 14 will yield the configuration depicted in FIG. 15 in which valve actuator 14 has been depressed thereby permitting fuel to flow through the valve and the fuel nozzle (not shown). In particular, and as more clearly depicted in FIG. 16, such depression of valve actuator 14 will cause compression of spring 30 and urging of fuel nozzle 20 upward and partially out of valve housing 28 and body portion 12. Such lifting of fuel nozzle 20 upward will permit fuel to flow from chamber 15 through the valve and out of nozzle 20 whereupon it will have been ignited by sparks produced by flint 22 and toothed surface 19 of spark-producing assembly wheel 18. Such fuel will continue to flow and burn as long as sufficient pressure is maintained on valve actuator 14. The downward movement of valve actuator 14 is limited by latch interfering portion 16B contacting a portion of housing 12 in the vicinity of cavity 27 and adjacent to housing interfering portion 12B, as depicted in FIGS. 15 and 16.

Figure 16:
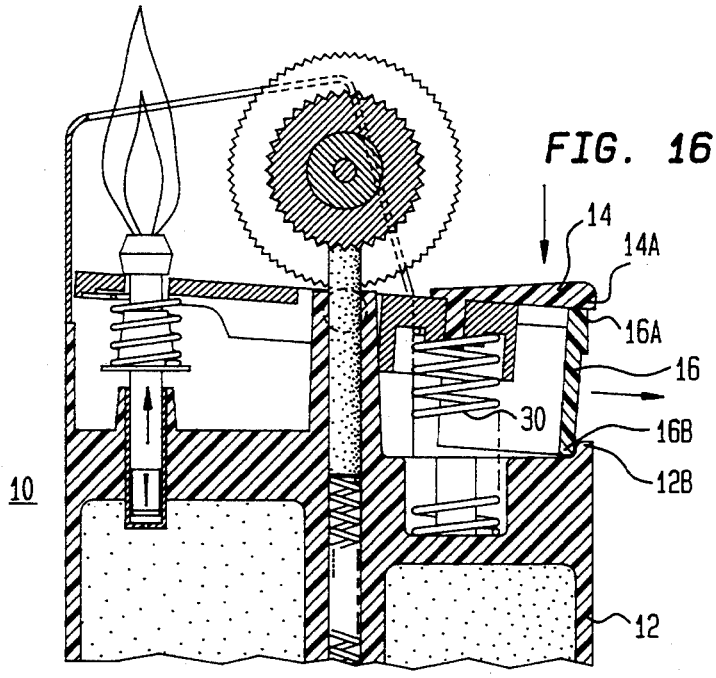
FIG. 16 is a partial cross-sectional view of the lighter of FIG. 15 in greater detail.

As seen in FIGS. 15 and 16, depression of valve actuator 14 urges latch 16 downward as well as outward toward its latched position. As long as valve actuator 14 remains depressed, such outward movement is limited by the contact between latch 16 and housing 12 in the general vicinity of portions 12B and 16B. Such outward movement is initially due to the contact between latch 16 and camming means 5 (FIGS. 1, 11, 12) as the latch is moved downward. Such contact causes latch 16 to disengage from actuator 14 by disengaging latch structure 39 from actuator structure 37 causing latch 16 to move outward. The outward movement of latch 16 is also due to the relative shapes, materials and configurations of valve actuator 14 and latch 16 which cause actuator 14 to force latch 16 outward as described in conjunction with FIGS. 6–8. Accordingly, latch 16 is urged outward by camming means 5 as well as valve actuator 14.

Figure 17:
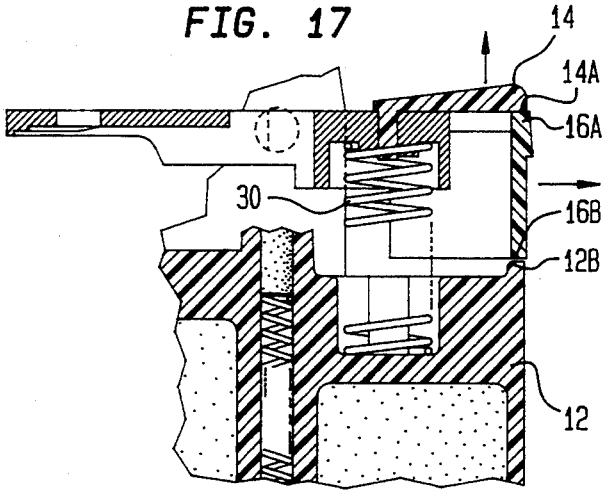
FIG. 17 is a partial cross-sectional view of the lighter of FIG. 15 after the value actuator has been fully depressed and released.

As depicted in FIG. 17, once pressure is removed from valve actuator 14, the valve actuator will move upward due to the biasing force provided by spring 30, and the flame will be extinguished. Advantageously, as valve actuator 14 moves upward, latch 16 moves toward its latched position. Additionally, as valve actuator 14 moves upward so does latch 16 due to the portion of latch 16 which is within groove 33 of valve actuator 14 (FIG. 3). As described in conjunction with FIGS. 15 and 16, depression of valve actuator 14 causes latch 16 to move outward and to disengage from actuator 14 by disengaging latch structure 39 from actuator structure 37. However, even when valve actuator 14 is fully depressed, latch 16 is not fully outward and not fully latched due to the interference between the latch and the housing in the vicinity of housing interference portion 12B and latch interfering portion 16B as best seen in FIGS. 15 and 16. Latch 16 will enter its fully latched position only when the valve actuator is moved fully upward thus enabling the latch to move fully outward. As described in conjunction with FIGS. 6–8 as well as FIGS. 15 and 16, the relative shapes, materials and configurations of valve actuator 14 and latch 16 cause actuator 14 to force latch 16 fully outward.

While it is apparent that the invention herein disclosed is well-calculated to fulfill the objects above stated, it will be appreciated that numerous modifications and embodiments may be devised by those skilled in the art, and it is intended that the appended claims cover all such modifications and embodiments as fall within the true spirit and scope of the present invention.

More specifically, the latch means and lighter disclosed and claimed herein are not limited to use in disposable lighters. Moreover, the present invention is not limited to a latch means in which a latch is moved solely in an inward direction to an unlatched position. Similarly, the latch may be positioned at other locations within the lighter body so as to prevent depression of the valve actuator by interfering with other portions of the valve actuator.

We claim:

1. A lighter comprising:

a housing defining a fuel reservoir;

valve means for releasing fuel from said fuel reservoir;

means for igniting the released fuel;

actuator means operatively engaged with said valve means such that fuel is released when said actuator means is depressed along a longitudinal axis of said housing;

interference means for preventing the movement of said actuator means along the longitudinal axis of said housing when in a closed position, said interference means being selectively movable inward towards the longitudinal axis to an open position out of interference with said actuator means, thereby allowing said actuator means to be depressed, and said interference means including an extending, resiliently deformable portion cooperating with a mating element for securing the interference means in the open position wherein said deformable portion is in a relaxed and undeformed condition in the open position, said portion being deformed by the mating element as the interference means is moved inward and returning to the undeformed condition and being under no loading when in said closed position; and camming means operatively engaging said interference means when said actuator means is depressed for moving said interference means outward away from said longitudinal axis into the closed position, said deformable portion being deformed by the mating element during such outward movement.

2. The lighter according to claim 1 wherein said actuator means includes protrusion means on either side thereof forming said mating element, and said interference means includes corresponding indentation means formed on said resiliently deformable portion for mating with said protrusion means, said interference means normally retained in said closed position by resiliently interfering with said actuator means.

3. The lighter according to claim 2 wherein said interference means is retained in said open position by said protrusion means resiliently mating with said indentation means.

4. The lighter according to claim 3 wherein said interference means is a latch having an interfering portion which is movable inward towards the longitudinal axis of said housing into alignment with a cavity in said housing.

5. The lighter according to claim 4 wherein said latch is slideably mounted to said valve actuator.

6. The lighter according to claim 3 wherein said means for igniting comprises flint material and a rotatable spark-producing wheel having a toothed surface positioned and arranged to selectively frictionally contact said flint material.

7. The lighter according to claim 3 wherein said means for igniting comprises electric spark-producing means.

8. The lighter according to claim 3 wherein said means for igniting comprises piezoelectric spark-producing means.

9. The lighter according to claim 1 wherein said interference means is movable along only a single path from said closed position to said open position.

10. A lighter normally maintained in a latched configuration comprising:

a housing having a longitudinal axis;

fuel supply means for supplying fuel;

ignition means for igniting said fuel;

valve means for controlling the flow of said fuel;

a valve actuator operatively engaged with said valve means, said valve actuator preventing the flow of said fuel when in a first position, said valve actuator being depressible along said longitudinal axis into a second position to permit the flow of fuel;

a latch member separate from the valve actuator and positioned at least partially beneath said valve actuator in a first position normally preventing said valve actuator from being depressed into said second position by interfering with the movement thereof along the longitudinal axis of said housing, wherein inward movement of said latch towards the longitudinal axis of said housing enables an interfering portion of said latch to become aligned with a cavity in said housing, and places said lighter in an unlatched configuration, said cavity being sufficient in size to accommodate said interfering portion so as to enable said valve actuator to be depressed; and camming means, comprising an upright surface of the lighter housing disposed to interfere with the latch member in the unlatched configuration when the valve actuator is depressed, for forcing said latch outward away from said longitudinal axis into its first position and the lighter out of its unlatched configuration when said valve actuator is depressed, moving said latch downward along a direction parallel to the longitudinal axis and into contact with said upright surface.

11. The lighter according to claim 10 wherein said ignition means comprises a spark-producing wheel and a flint urged against said wheel and wherein sparks are produced by rotation of said wheel.

12. The lighter according to claim 10 wherein said ignition means comprises electric spark-producing means.

13. The lighter according to claim 10 wherein said ignition means comprises piezoelectric spark-producing means.

14. The lighter according to claim 10 wherein said latch is constrained to move along only a single path when said lighter is configured from said latched configuration to said unlatched configuration.

15. The lighter according to claim 10 wherein said lighter is maintained in each of said latched and unlatched configurations by the interaction between said latch and said valve actuator.

16. The lighter according to claim 10 wherein said latch is slideably attached to said valve actuator between said latched and unlatched configurations.

17. The lighter according to claim 16 wherein said latch is under no loading in each of said latched and said unlatched configuration.

18. The lighter according to claim 10 wherein said latch comprises a portion normally positioned between at least a portion of said valve actuator and at least a portion of said housing.

19. The lighter according to claim 10 wherein said unlatched configuration is maintained until said valve actuator is depressed and released.

20. A lighter comprising:

a housing having a fuel compartment;

fuel release means for releasing fuel from said fuel compartment;

means for igniting said released fuel;

a thumb-depressible actuator operatively engaged with said release means such that when depressed along a longitudinal axis of said housing fuel is released, said actuator having protrusions on either sides thereof;

a U-shaped latch disposed between said actuator and a portion of said housing for preventing said actuator from being depressed by abutting at least a portion of said housing, said latch having indentations on either sides thereof, said latch being selectively movable inward towards the longitudinal axis of said housing such that said protrusions engage and mate with said indentations thereby holding said latch inward, wherein said movement inward produces a void between said latch and said housing, said void sufficient in size to allow said actuator to be depressed so as to allow fuel to be released from said fuel compartment; and camming means operatively engaged with said latch when said latch is in its inward position and when said actuator is depressed for disengaging said protrusions from said indentations thereby allowing said latch to move outward away from the longitudinal axis of said housing.

21. The lighter according to claim 20 wherein said latch is slideably attached to said actuator.

22. The lighter according to claim 20 wherein said means for igniting includes flint material and a rotatable spark-producing wheel having a toothed surface positioned and arranged to selectively frictionally contact said flint material.

23. The lighter of claim 20 wherein said means for igniting includes electric spark-producing means.

24. The lighter of claim 20 wherein said means for igniting includes piezoelectric spark-producing means.

* * * * *